US009568266B1

(12) United States Patent
LoRocco et al.

(10) Patent No.: US 9,568,266 B1
(45) Date of Patent: Feb. 14, 2017

(54) ARTICULATED SUPPORT STICK FOR WEAPONS AND OTHER DEVICES

(71) Applicant: TruGlo, Inc., Richardson, TX (US)

(72) Inventors: Paul LoRocco, Dallas, TX (US); John Estridge, Garland, TX (US); Alvin R. Wirthlin, Frisco, TX (US)

(73) Assignee: TruGlo, Inc., Richardson, TX (US)

( * ) Notice: Subject to any disclaimer, the term of this patent is extended or adjusted under 35 U.S.C. 154(b) by 0 days.

(21) Appl. No.: 14/329,893

(22) Filed: Jul. 11, 2014

Related U.S. Application Data

(60) Provisional application No. 61/844,988, filed on Jul. 11, 2013.

(51) Int. Cl.

| | |
|---|---|
| ***F41C 27/00*** | (2006.01) |
| ***F41A 9/62*** | (2006.01) |
| ***F41A 29/00*** | (2006.01) |
| ***F41A 23/06*** | (2006.01) |
| ***F41B 5/14*** | (2006.01) |

(52) U.S. Cl.
CPC ..... *F41A 23/06* (2013.01); *F41B 5/1453* (2013.01)

(58) Field of Classification Search
CPC ..... F41A 23/16; F41A 23/04; F41A 23/06
USPC ..... 248/685, 121, 351, 354.1, 122.1, 125.1,248/125.7, 125.8, 125.9, 176.1, 176.3, 284.1; 42/94
See application file for complete search history.

(56) References Cited

U.S. PATENT DOCUMENTS

| | | | | | |
|---|---|---|---|---|---|
| 4,676,021 | A * | 6/1987 | Groba | F16B 2/246 | 42/94 |
| 5,149,900 | A * | 9/1992 | Buck | F41A 23/16 | 248/122.1 |
| 5,345,706 | A * | 9/1994 | Brown | F41A 23/06 | 42/94 |
| 5,784,820 | A * | 7/1998 | Wood | F41C 33/001 | 42/94 |
| 5,930,931 | A * | 8/1999 | Watson | F41A 23/04 | 206/317 |
| 6,009,655 | A * | 1/2000 | Austin | F16M 13/04 | 42/94 |
| 6,027,087 | A * | 2/2000 | Lindemann | A63C 11/221 | 248/188.5 |
| 7,065,914 | B1 * | 6/2006 | Wagner, II | F41C 23/04 | 124/74 |
| 7,669,827 | B2 * | 3/2010 | Urrutia | F21S 4/10 | 248/351 |
| 7,677,233 | B2 * | 3/2010 | Bednar | F41A 23/06 | 124/25 |
| 2005/0262753 | A1 * | 12/2005 | Lahti | F41C 23/12 | 42/94 |
| 2007/0068501 | A1 * | 3/2007 | Bednar | F41B 5/123 | 124/25 |

(Continued)

*Primary Examiner* — Terrell McKinnon
*Assistant Examiner* — Michael McDuffie
(74) *Attorney, Agent, or Firm* — Alvin R. Wirthlin

(57) ABSTRACT

An articulated support stick for supporting a weapon or other device, includes a handle for grasping by a user, a cradle connected to the handle for receiving and supporting the weapon or other device, a leg for supporting the handle while directing a portion of the weight of the weapon or other device along the leg, and an articulated joint assembly connected between the handle and the leg so that the handle can be manipulated by the user about mutually orthogonal axes with respect to the leg to thereby adjust the cradle portion and thus a position of the weapon or other device while preserving the user's strength.

20 Claims, 13 Drawing Sheets

(56) References Cited

U.S. PATENT DOCUMENTS

| | | | | |
|---|---|---|---|---|
| 2007/0266609 | A1* | 11/2007 | Wuertz | F41A 23/08<br>42/94 |
| 2010/0269393 | A1* | 10/2010 | Bean | F41A 23/06<br>42/94 |
| 2013/0167424 | A1* | 7/2013 | Nail | F41A 23/06<br>42/94 |
| 2013/0327281 | A1* | 12/2013 | Michels | A01K 15/003<br>119/801 |

* cited by examiner

ARTICULATED SUPPORT STICK FOR WEAPONS AND OTHER DEVICES

CROSS-REFERENCE TO RELATED APPLICATIONS

This application claims the benefit of U.S. Provisional Application No. 61/844,988 filed on Jul. 11, 2013, the disclosure of which is hereby incorporated by reference.

BACKGROUND OF THE INVENTION

This invention relates generally to supports for steadying weapons during aiming, and more particularly to an articulated shooting stick for crossbows, rifles, shotguns and other weapons.

Crossbows, rifles, shotguns, and other weapons are heavy in nature. With their centers of mass located away from the shooter's body, they are typically difficult to hold steady and manipulate during aiming for consistent shot placement. The same holds true for cameras binoculars, telescopes, and other devices. This problem is exacerbated when hunting with crossbows or when the user must maintain a position for a long period of time until the prey is properly oriented and at an appropriate distance for photographing, observing, shooting, and so on.

The prior art includes a plurality of apparatuses for steadying portable devices which are to be aimed by a user. For example, tripods are commonly used to steady cameras or telescopes. In many situations, tripods function admirably for this purpose. However, although many tripods are portable, setting a tripod up and taking it down often takes too much time for the user, can be difficult to transport efficiently, and may be too bulky to set up in a tree stand. Some prior art solutions suggest relieving some of this bulkiness by providing a support stick that rest against a user at one end and support a crossbow, firearm or other device at the other end. Such devices are typically inflexible, in that there is no mechanism for allowing precise positioning and control of the crossbow, firearm, or other device with the user's fine motor control. Thus, when it is desirous to take aim at potential game or a distant target, and follow the target as it moves within the field of view and possibly closer to and/or further away from the user, prior art support sticks fall short.

Moreover, when using a crossbow for example, the safety of the user may become compromised due to the orientation of the crossbow stock and the fingers of the user during firing. The crossbow stock naturally forces the user to orient his or her fingers upwards, which may interfere with the crossbow string during release of the bolt and lead to serious injury.

It would therefore be desirous to provide a support stick that overcomes at least one or more disadvantages of the prior art. It would further be desirous to provide a allows a user to hold a weapon or other device in an aiming stance while preserving the user's strength and allowing the user to fine tune a potential shot or image by manipulating the support stick with the user's fine motor control.

SUMMARY OF THE INVENTION

In accordance with one aspect of the invention, an articulated support stick for supporting a weapon or other device, includes a handle for grasping by a user, a cradle connected to the handle for receiving and supporting the weapon or other device, a leg for supporting the handle while directing a portion of the weight of the weapon or other device along the leg, and an articulated joint assembly connected between the handle and the leg so that the handle can be manipulated by the user about mutually orthogonal axes with respect to the leg to thereby adjust the cradle portion and thus a position of the weapon or other device while preserving the user's strength.

It is noted that the drawings are intended to depict only typical embodiments of the invention and therefore should not be considered as limiting the scope thereof. It is further noted that the drawings may not be necessarily to scale. The invention will now be described in greater detail with reference to the accompanying drawings.

DETAILED DESCRIPTION OF THE INVENTION

Figure 1:
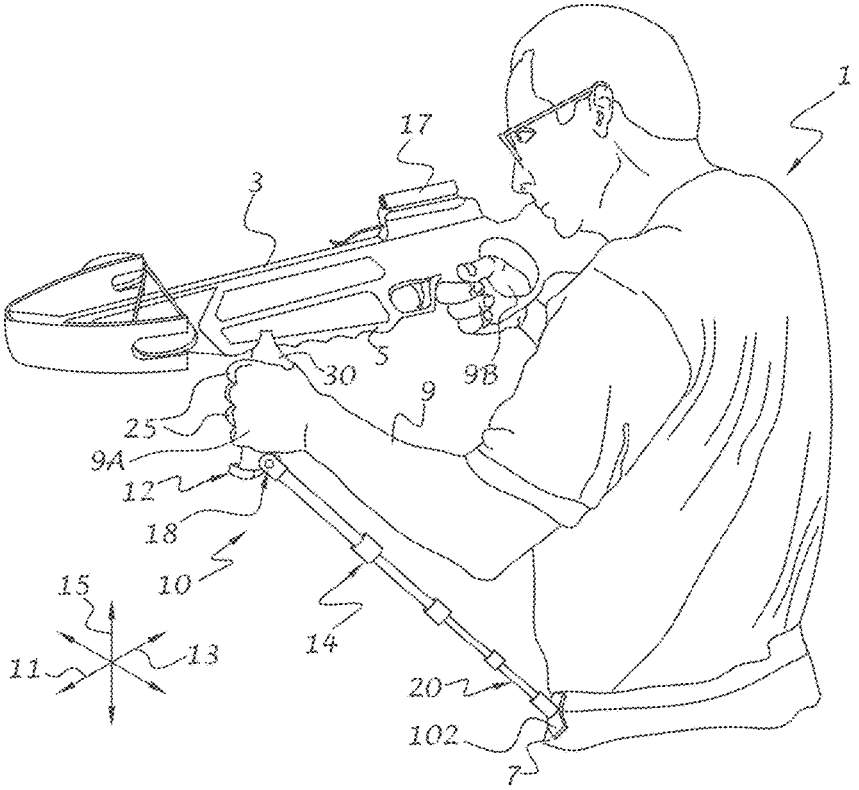
FIG. 1 illustrates an exemplary use of an articulated support stick in accordance with the invention.
Figure 2:
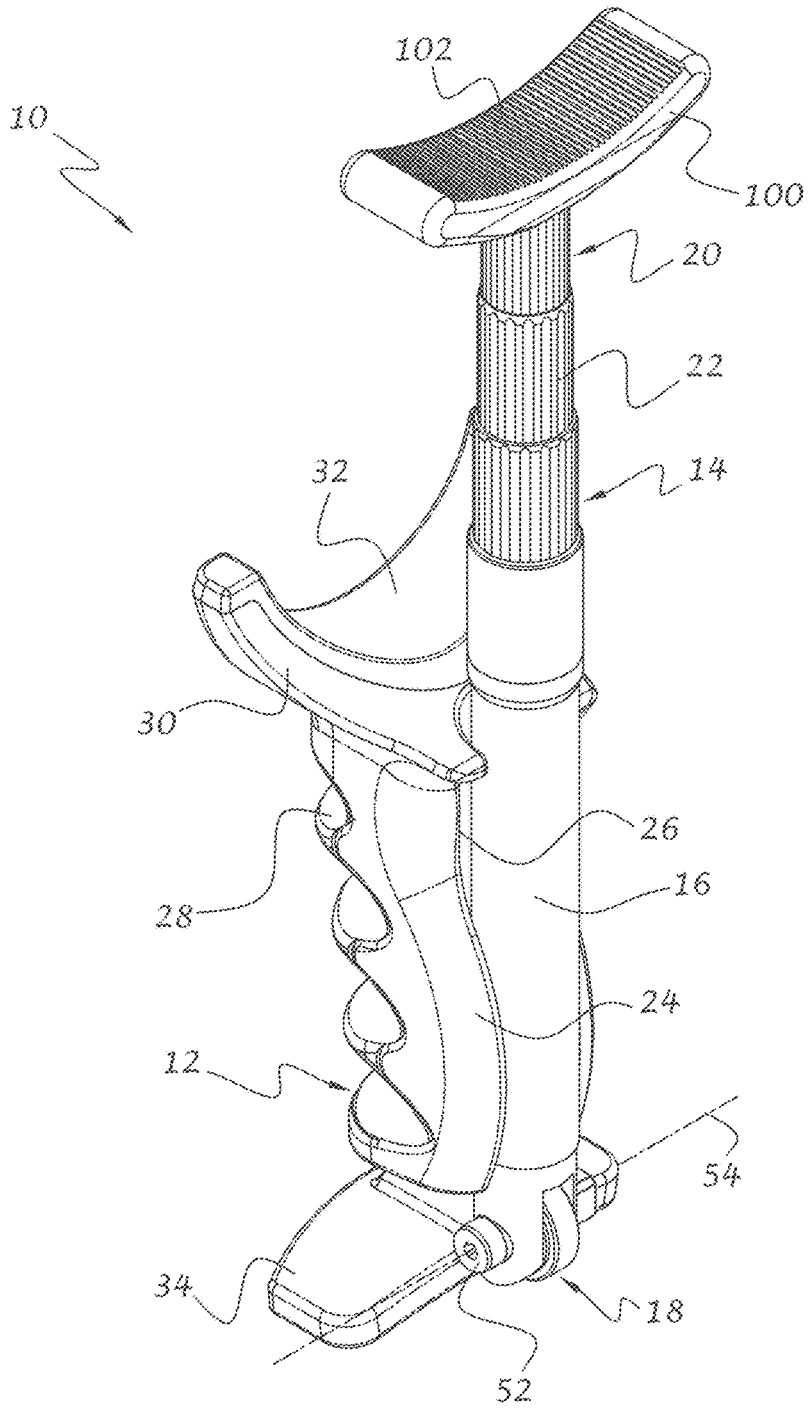
FIG. 2 is an isometric rear view of the articulated support stick in accordance with one exemplary embodiment of the invention in a folded and retracted position for carrying and storage.
Figure 3:
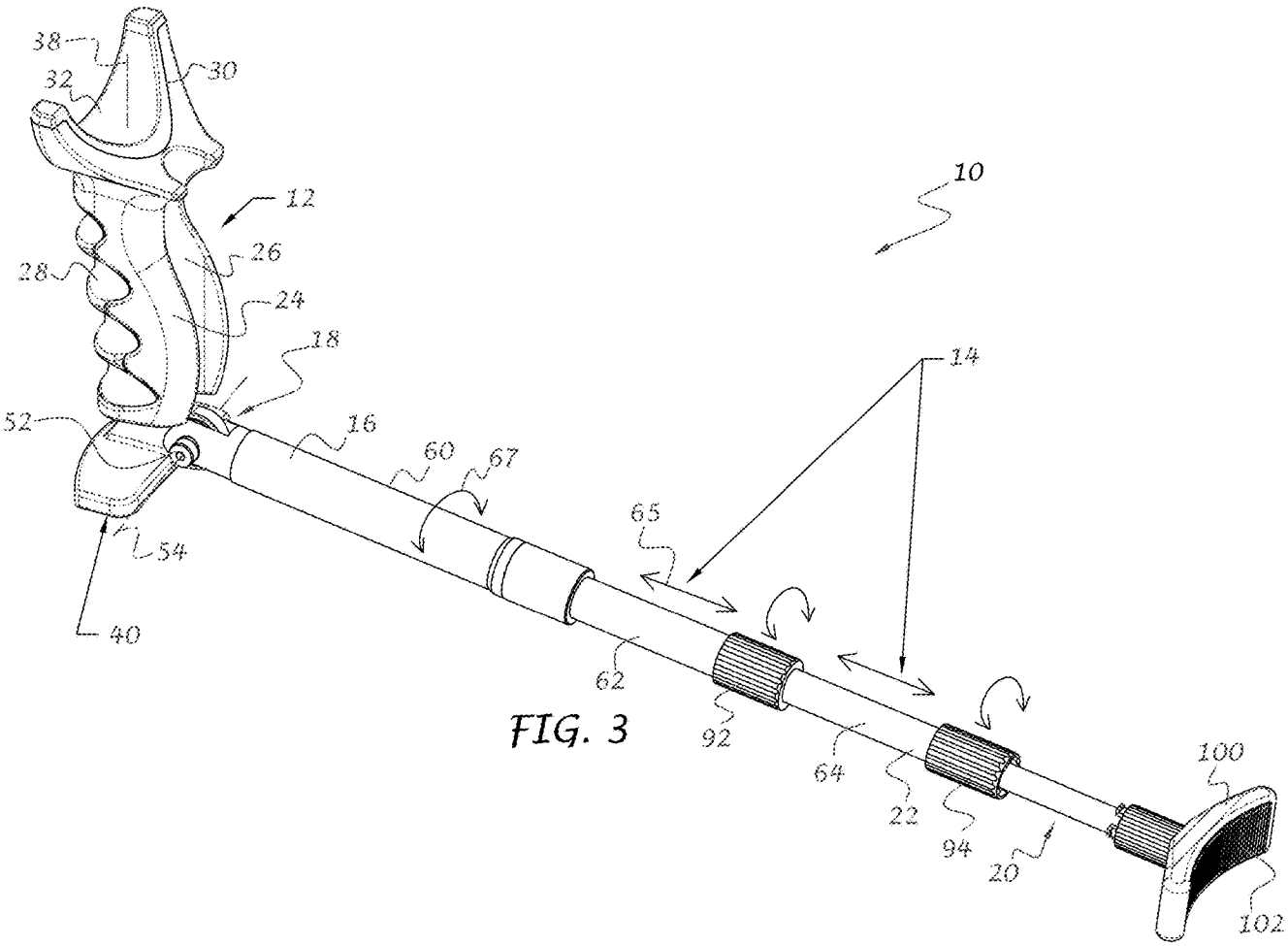
FIG. 3 is an isometric rear view thereof with the articulated support stick in the unfolded and extended position for use as illustrated in FIG. 1.

Referring now to the drawings, and to FIG. 1 in particular, an exemplary use of an articulated support stick 10 in accordance with the invention is shown. A user 1 is illustrated holding a crossbow 3 in an aiming position with an articulated support stick 10 extending between a beam 5 of the crossbow and an anchor point or area 7, the position of which is defined by the user. In this position, the crossbow is supported by both the user 1 and the articulated support stick 10 so that the user can manipulate the crossbow with one hand (such as hand 9A for a right-handed user) about two or three mutually perpendicular axes, such as axes 11, 13, and 15 shown in FIG. 1, through an articulated joint assembly 18. The position and/or orientation of the crossbow can further be adjusted in combination with other relatively movable components of the support stick 10, as will be described in further detail below. With this arrangement, relatively little force by the user is needed to manipulate and steady the crossbow or other device when compared to the strength that would otherwise be required in the absence of the articulated support stick 10. With a substantial amount of the crossbow weight directed to the anchor point or area 7 of the user, the user's other hand (such as hand 9B for a right-handed user) can be used for holding the crossbow steady against the user's shoulder while precisely adjusting the sweep, tilt, and cant angle of the crossbow to align the crossbow (or crossbow sight 17) with a desired target. As shown in FIG. 1, opposing forces associated with supporting the weight of the crossbow are redirected from the user's arm 9 to the articulated support stick 10 and the user-defined anchor area 7. In this manner, the user's arm 9 will not fatigue as fast, thereby enabling the user to use his or her fine motor movement to precisely adjust the orientation, and thus the aiming, of the crossbow 3 or other weapon.

Although the present invention is described for use with crossbows in order to facilitate description of the invention, it will be understood that the invention is not limited thereto, but may also be used to support other weapons, including but not limited to, rifles, shotguns, handguns with long barrels, and so on, as well as other elongate devices that require extra support and fine motor control during use, such as the support and adjustment of cameras with telescopic lenses, ranging scopes, and so on.

With additional reference to FIGS. 2-8, the articulated support stick 10 preferably includes three main sections, namely a handle assembly 12 for grasping and manipulation by a user, a leg assembly 14 for transferring the weight of the crossbow or other device from the user's hand to the user's anchor point 7, and an articulated joint assembly 18 for pivotally connecting the handle assembly 12 to the leg assembly 14. The leg assembly 14 is preferably telescopic in construction so that the articulated support stick 10 can be collapsed to a compact state for transportation and storage. However, it will be understood that the leg assembly 14 need not be telescopic but may be formed of one or more support tubes that can be removably connected together and/or to the articulated joint assembly. As shown in the exemplary embodiment, the leg assembly 14 is telescopic and has a first end 16 operably associated with the articulated joint assembly 18, and a compliant assembly 20 connected to a second or lower end 22 of the leg assembly 14.

The handle assembly 12 preferably includes a two piece, ergonomically shaped grip with a base portion 24 having a rear slot 26 for receiving the telescoping leg assembly 14 when folded, and a gripping section 28 that interfaces with the fingers 25 (FIG. 1) of a user. The base portion 24 can be constructed of a durable polymer material, and the gripping section 28 can be constructed of an elastomeric material, and bonded with the gripping section 28 through an overmolding process during manufacture. However, it will be understood that other materials and manufacturing processes and/or connection means can be used without departing from the spirit and scope of the invention. The base portion 24 also includes a saddle 30 formed at a first end thereof for receiving and supporting the crossbow 3 (FIG. 1) or other weapon. A saddle gripping section 32 is also preferably constructed of an elastomeric material and adhered to the saddle 30 through overmolding or other manufacturing processes and/or connection means. The gripping section 32 interfaces with the fore-grip of the crossbow or other weapon to prevent scratches and to ensure a secure frictional grip between the articulated support stick and the crossbow.

With particular reference to FIGS. 4, 4A, 6, and 8, the articulated joint assembly 18 preferably includes a pivot bar or pin 34 that extends into a bore 36 formed in the handle assembly 12 for relative rotational movement about a first pivot axis 38 (FIGS. 6 & 8) to enable the user to adjust the "sweep" or generally horizontal aiming direction of the crossbow or other device when the articulated support stick is in the extended position (FIG. 6) and the leg assembly 14 is anchored against the user or other relatively inanimate support. The pivot bar 34 has a laterally extending wing 40 (best shown in FIG. 3) attached near the base thereof which provides balance for the entire assembly so it won't fall over during use, such as when the crossbow is resting on the user's knee or other unstable and/or stable surface. The pivot bar also includes a tab 44 with an opening 42 that mates with openings 46, 48 (FIG. 4A) formed in a yoke 50 that forms part of the articulated joint assembly 18. A bolt 52 extends through the openings 42, 46, and 48 to pivotally connect the handle assembly 12 to the telescoping leg assembly 14 about a second pivot axis 54 which is coincident with a central axis of the openings 46, 48 (and 42). The second pivot axis 54 preferably extends perpendicular to the first pivot axis 38 so that the handle assembly 12 can rotate about two mutually perpendicular axes. The two separate pivoting movements allows for windage (or sweep) and elevation adjustment of the handle assembly 12, and thus windage (left to right sweeping movement) and elevation (up and down movement) adjustment of the crossbow or other weapon with respect to the leg assembly 14.

Figure 4:
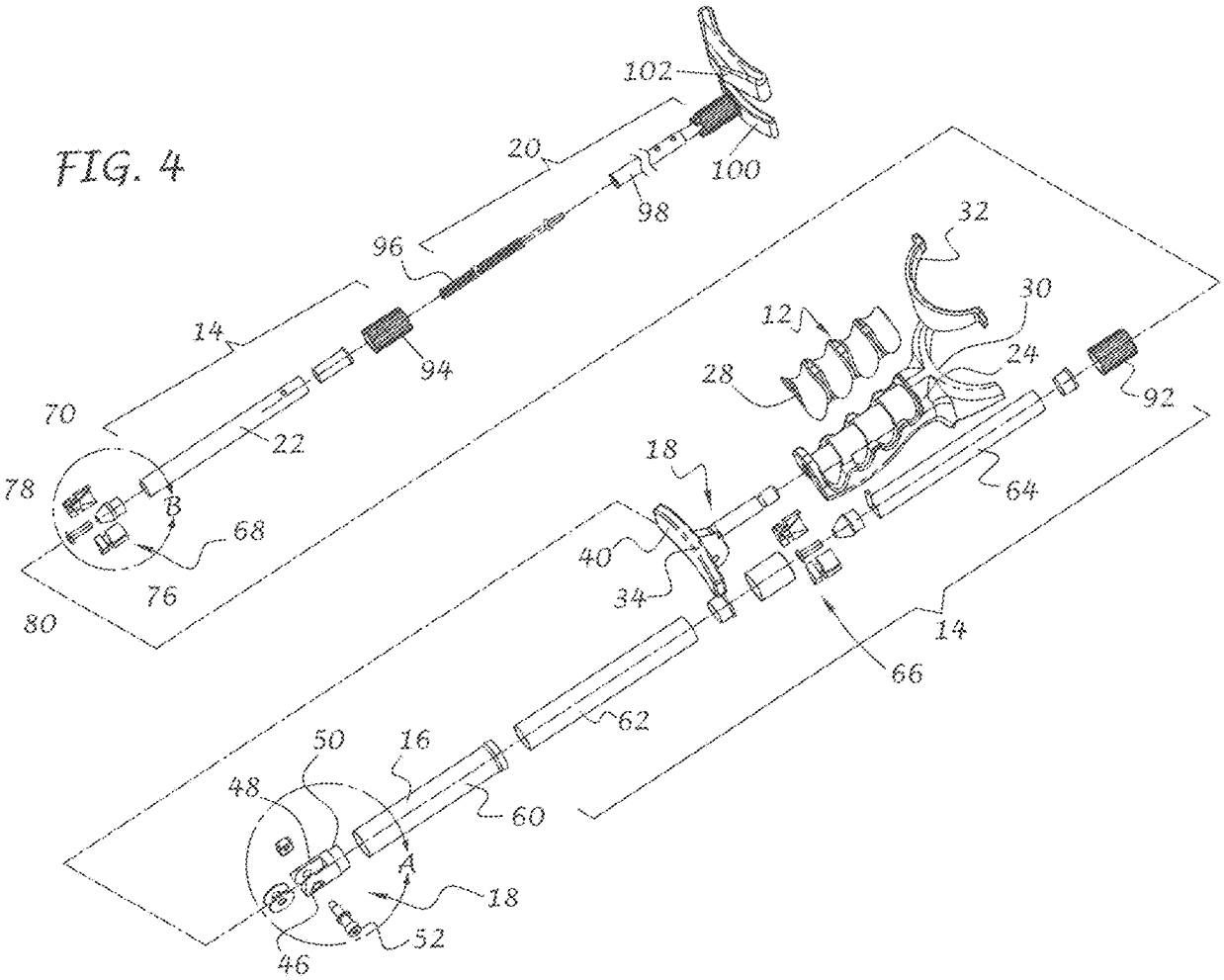
FIG. 4 is an exploded isometric view of the articulated support stick.
Figure 4A:
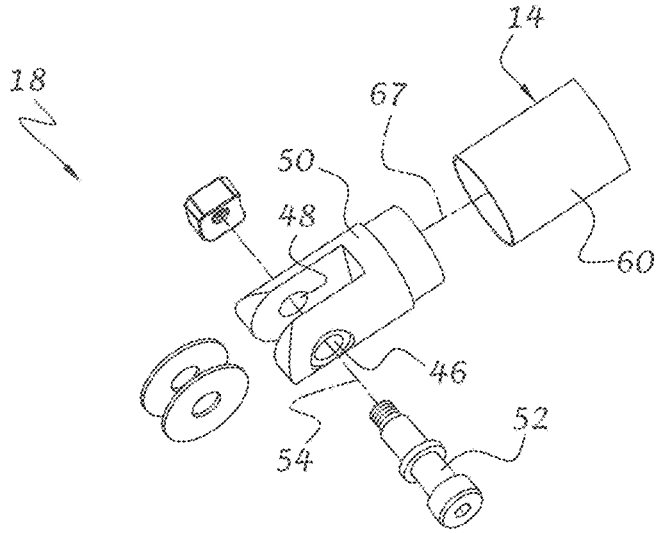
FIG. 4A is an enlarged view of an articulated joint assembly taken along circle A of FIG. 4.
Figure 4B:
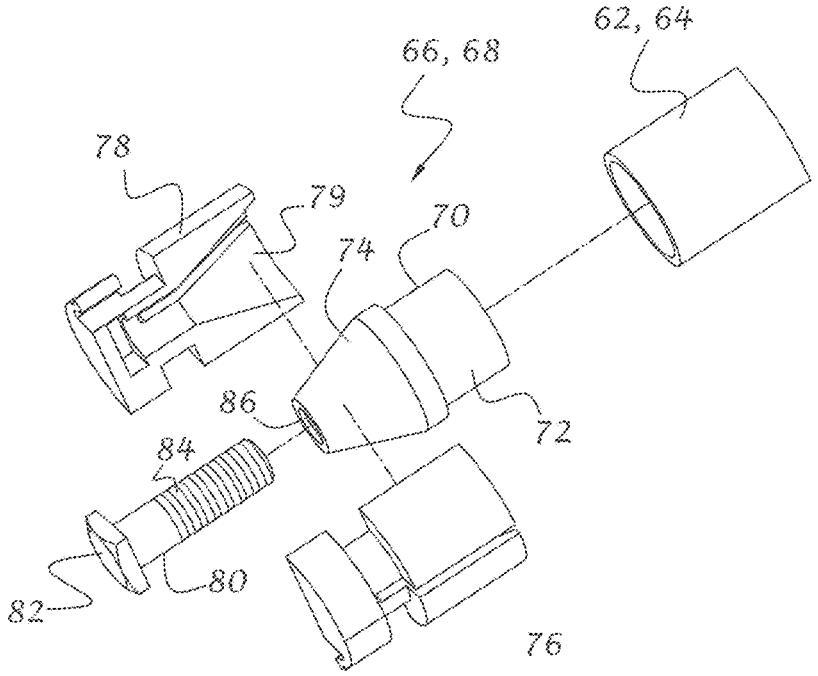
FIG. 4B is an enlarged view of a first slip joint assembly taken along circle B of FIG. 4 for expanding and retracting the support stick to use and non-use positions, respectively.
Figure 5:
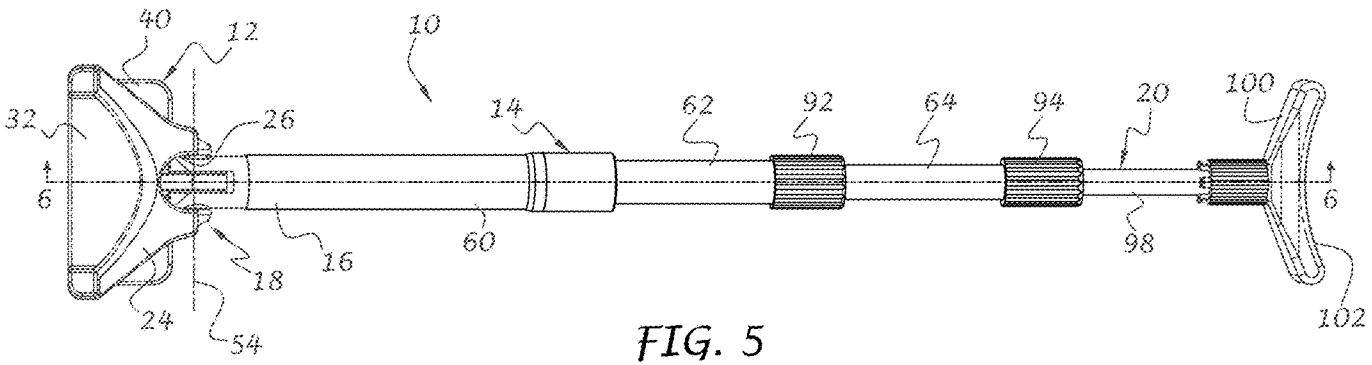
FIG. 5 is a top plan view of the articulated support stick in the unfolded and extended position.
Figure 6:
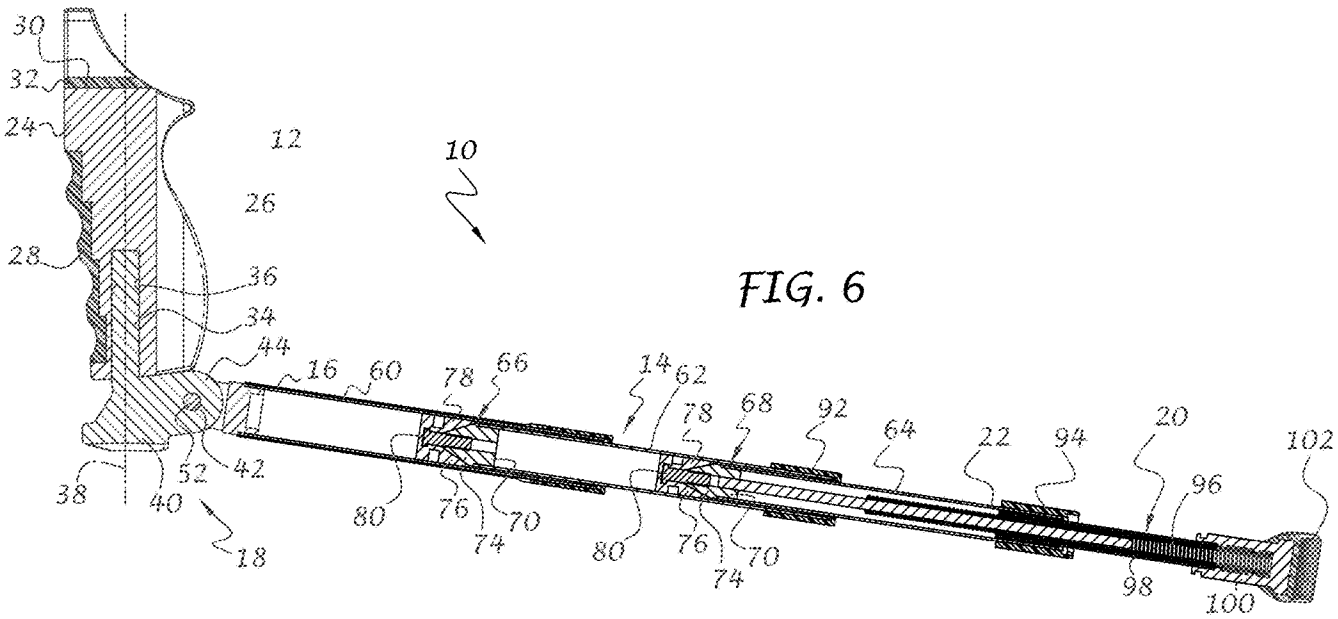
FIG. 6 is a sectional view thereof taken along line 6-6 of FIG. 5.
Figure 7:
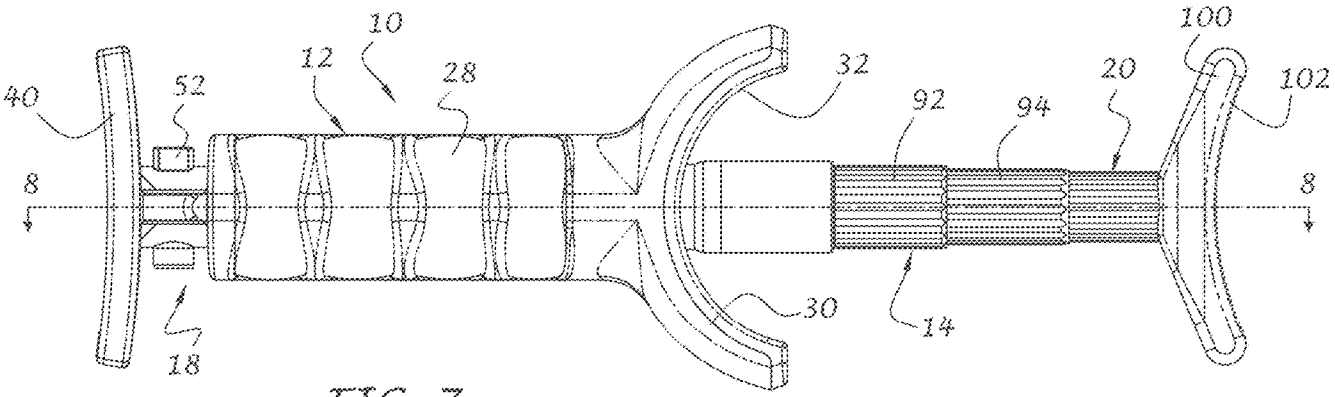
FIG. 7 is a top plan view of the articulated support stick in the folded and retracted position.
Figure 8:
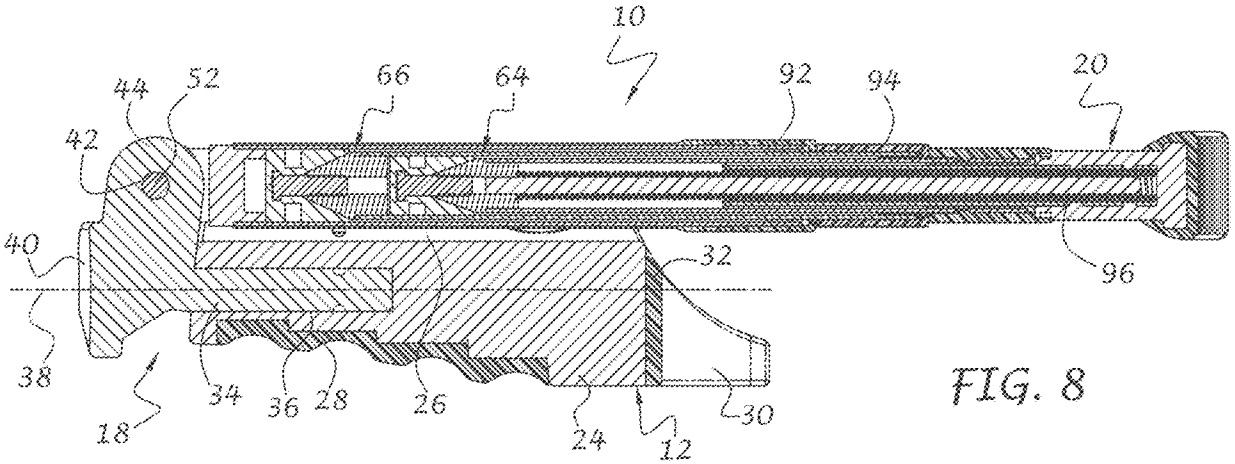
FIG. 8 is a sectional view thereof taken along line 8-8 of FIG. 7.
Figure 9:
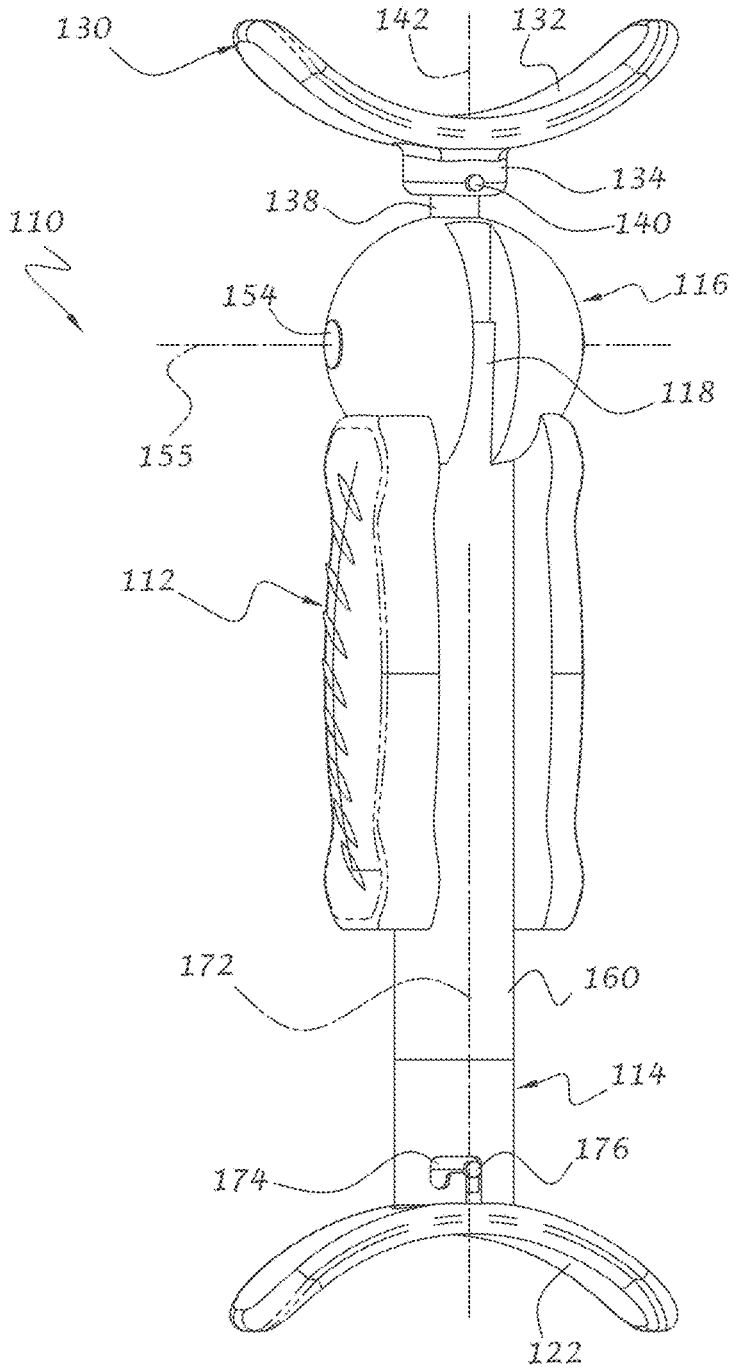
FIG. 9 is a top plan view of an articulated support stick, in accordance with a further exemplary embodiment of the invention, in the folded and retracted position.

With reference to FIGS. 4, 4B, 6, and 8, the telescoping leg assembly 14 preferably includes telescoping tubes 60, 62, and 64 for adjusting the overall length of the support assembly 10. This is useful to account for variations in user sizes and preferences, or using the support stick while sitting or standing where the length of the support stick needs to be adjusted. The tube 60, as shown in FIGS. 4 and 4A, receives the yoke 50 so that the tube 60 is pivotally connected to the handle assembly 12 for pivoting movement about the first and second axes 38 and 54, respectively, as previously described. The tube 60 can also be constructed to rotate about a third axis 65 (FIGS. 3, 4A and 4B) perpendicular to the second axis 54, and as denoted by the double arrow 67 in FIG. 3. In this manner, the handle assembly 12, and thus the crossbow or other device, can be pivotally adjusted about three mutually perpendicular axes, thereby providing the user complete control over moving the crossbow between left and right, up and down, and tilting or canting side to side positions. It will be understood that the tube 60 can be secured against movement so that only the first and second axes 38 and 54, respectively, are available for adjusting the position of the crossbow.

The tube 62 connects to the tube 60 via a first friction joint 66. Likewise, the tube 64 connects to the tube 62 via a second friction joint 68. Preferably, the friction joints 66 and 68 are similar in structure and function. Each friction joint includes a central hub 70 with a first connection section 72 that extends into the tube 62 or 64 in a friction fit or mechanical connection, and a second frustoconical section 74. Split clamping sections 76, 78 have inner frustoconical surfaces 79 that surround the frustoconical section 74. The head 82 of a bolt 80 is captured in the split clamping sections 76, 78 while the threaded shank 84 extends from the head 82 and into a threaded opening 86 of the central hub 70.

In use, the user can hold one tube while twisting the other either clockwise or counterclockwise to lock the position of the tubes or to release the tubes from the locked position. At the tube is rotated in one direction, the bolt 80 causes the frustoconical surfaces 79 to tighten against the frustoconical section 74 to thereby lock the tubes together. Likewise, as the tube is rotated in the opposite direction, the frustoconical surfaces become disengaged to thereby unlock the tubes. The friction joints thus become advantageous in providing a secure stance for the crossbow or other weapon during use. The amount of friction in each joint can be set by the user based on the weight of the crossbow (a heavier crossbow requires more friction to keep the joint locked). This joint should be tight enough to support the crossbow, yet loose enough to allow the user to smoothly move the joint during use. The movement in this joint allows the user to track an animal based on its position in the hunting field. For example, if a deer comes in underneath the hunter located on a tree stand, the down angle would be extreme, but if a shooter is standing on the ground, the angle is not nearly as severe, so the user can rotate his or her wrist to work the support stick much like a simple linkage system. To adjust the length, the ribbed handle 92 or 94 associated with the tubes 62 or 64, respectively, is turned to loosen the internal collet clamp, the leg is moved to move the desired length, then the ribbed handle is rotated clockwise to lock the leg adjustment. Each of the tube sections can be adjusted independently.

The lower compliant assembly 20 allows dynamic changes in the length of the support stick during use, such as when the user (sitting high above in a tree stand) is tracking an animal coming into the hunting field. The animal is first sighted at a long distance, but slowly moves in (requiring more and more down angle adjustments.) The user can track the animal by rotating the handle, moving the compliant section in/out, and rotating the handle left or right. These movements are fairly minimal, but all work together to provide a very stable and easy to use shooting system for the crossbow regardless of the shooting stance. The compliant assembly can include an elongate compression spring 96 located within a sleeve 98 as shown, or operated by a pressurized gas (or hydraulic) cylinder (not shown). An end cap 100 is located at the end of the sleeve 98 and a resilient foot 102 is connected to the end cap 100. The end cap 100 and resilient foot 102 can be generally C-shaped to accommodate different anchor points on the use body. However, it will be understood that other shapes can be used without departing from the spirit and scope of the invention.

It will be understood that the articulated support stick 10 is not limited to two telescopic sections or to a single compliant section, as more or less of these sections can be provided. In accordance with a further embodiment of the invention, the telescoping legs and/or the compliant assembly can be eliminated and a rigid rod substituted therefor, with or without the compliant assembly.

Referring now to FIGS. 9-12, an articulated support stick 110 in accordance with a further embodiment of the invention is illustrated. The articulated support stick 110 preferably includes a handle assembly 112 for grasping and manipulation by a user, a leg assembly 114 for transferring the weight of the crossbow or other device from the user's hand and arm to the user's anchor point 7 (FIG. 1), and an articulated joint assembly 116 for pivotally connecting the handle assembly 112 to the leg assembly 114. As in the previous embodiment, the leg assembly 114 is preferably telescopic in construction so that the articulated support stick 110 can be collapsed to a compact state for transportation and storage. However, it will be understood that the leg assembly 114 need not be telescopic but may be formed of one or more support tubes that can be removably connected together end-to-end and/or connected to the articulated joint assembly 116. As shown in this exemplary embodiment, the leg assembly 114 is telescopic and has a first end 118 operably associated with the articulated joint assembly 116, and a second or lower end 120 connected to a foot 122 for supporting the leg assembly 114 at an anchor point 7 (FIG. 1) of a user or other support, as in the previous embodiment.

The handle assembly 112 preferably includes an ergonomically shaped gripping section 124 formed on a base portion 126. A rear slot 128 is formed in the base portion 126 and is sized to receive the leg assembly 114 when folded. The base portion 126 can be constructed of a durable polymer material, and the gripping section 124 can be constructed of an elastomeric material and bonded to the base section through an overmolding process during manufacture. However, it will be understood that other materials and manufacturing processes and/or means for connecting the gripping section to the base portion can be used. It will be further understood that the base portion 126 can be provided without the gripping section 124 for manipulation by a user without departing from the spirit and scope of the invention.

A saddle 130 includes a curved gripping section 132 for receiving the stock of a crossbow, the barrel of a firearm, and so on, for supporting the weapon or other device when in use. The saddle 130 also includes a circular mounting section 134 that extends downwardly from the gripping section 134. A circular cavity 136 is formed in the mounting section 134 for receiving a first shaft or pivot pin 138, which forms part of the articulated joint assembly 116. The first pivot pin 138 normally will not be disconnected from the saddle 130 and thus a set screw 140 or the like extends through the wall of the mounting section 134 and engages the pivot pin 138 so that the saddle 130 rotates with the pivot pin about a first pivot axis 142 to enable the crossbow or other device to pivot or sweep in a generally horizontal direction.

The articulated joint assembly 116 further includes a body 144 that is preferably spherical in shape with an upper bore 146 formed therein for receiving the free end of the shaft 138. The shaft 138 is preferably pivotally retained in the upper bore 146 to enable pivotal or rotational movement of the saddle 130 about the first pivot axis 142 with respect to the spherically-shaped body 144. A second pivot pin 148 (FIGS. 11 and 12) extends into a lower bore 150 formed in the body 144. The second pivot pin 148 is preferably coaxial with the first pivot pin 138 and also extends into an opening 152 formed in the base portion 126 of the handle assembly 112. The second pivot pin 148 helps to stabilize the body 144 during rotation about the first pivot axis 142. A third pivot pin 154 extends through a bore 156 formed in the body 144 and creates a second pivot axis 155. The bore 156 preferably extends perpendicularly to the bores 146 and 150 and the pivot pin 154 is fixed against movement in the bore 156. A channel 158 is formed in the body 144 and intersects with the bores 146, 150, and 156.

Figure 10:
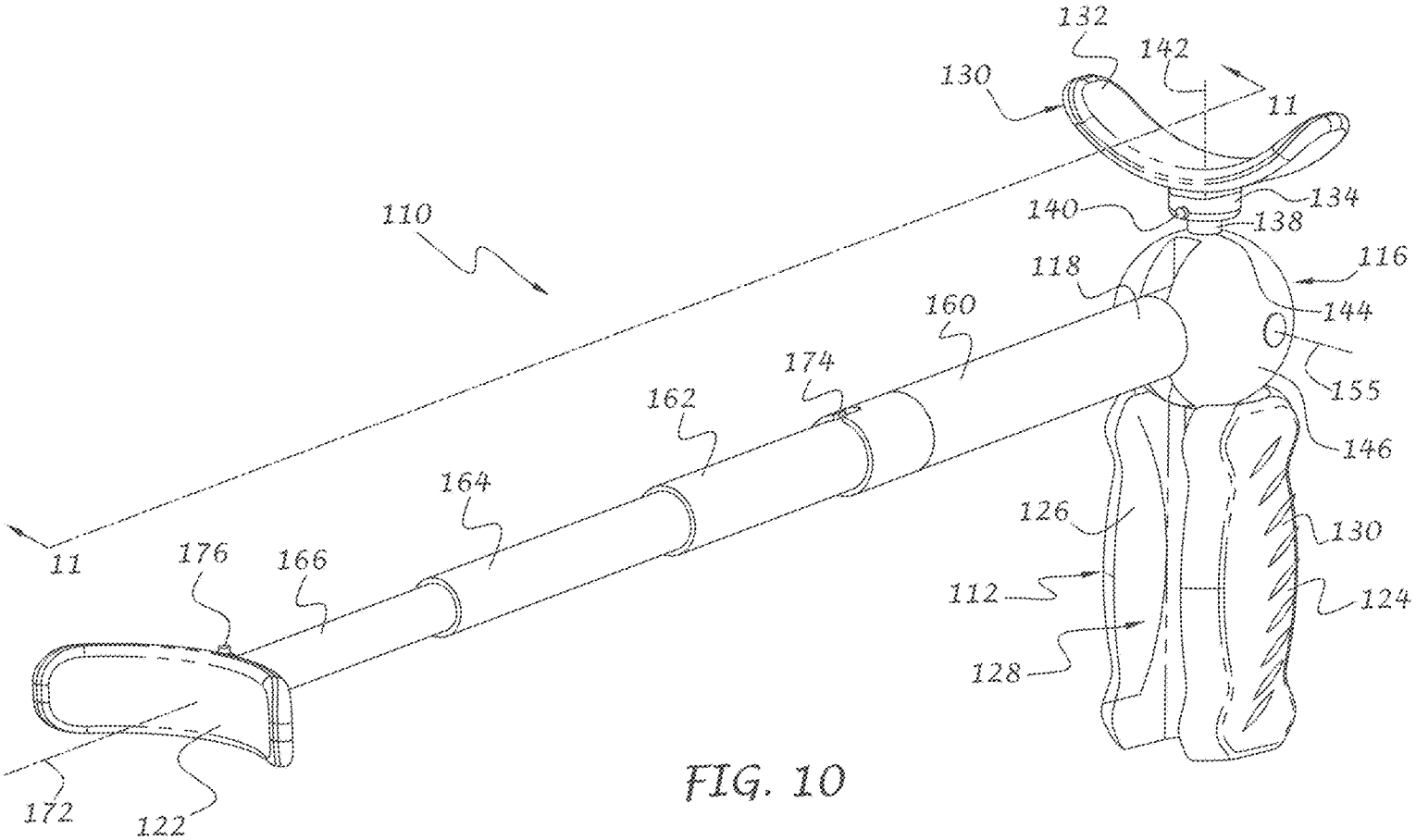
FIG. 10 is an isometric rear view thereof with the articulated support stick in the unfolded and extended position for use, such as illustrated in FIG. 1.
Figure 11:
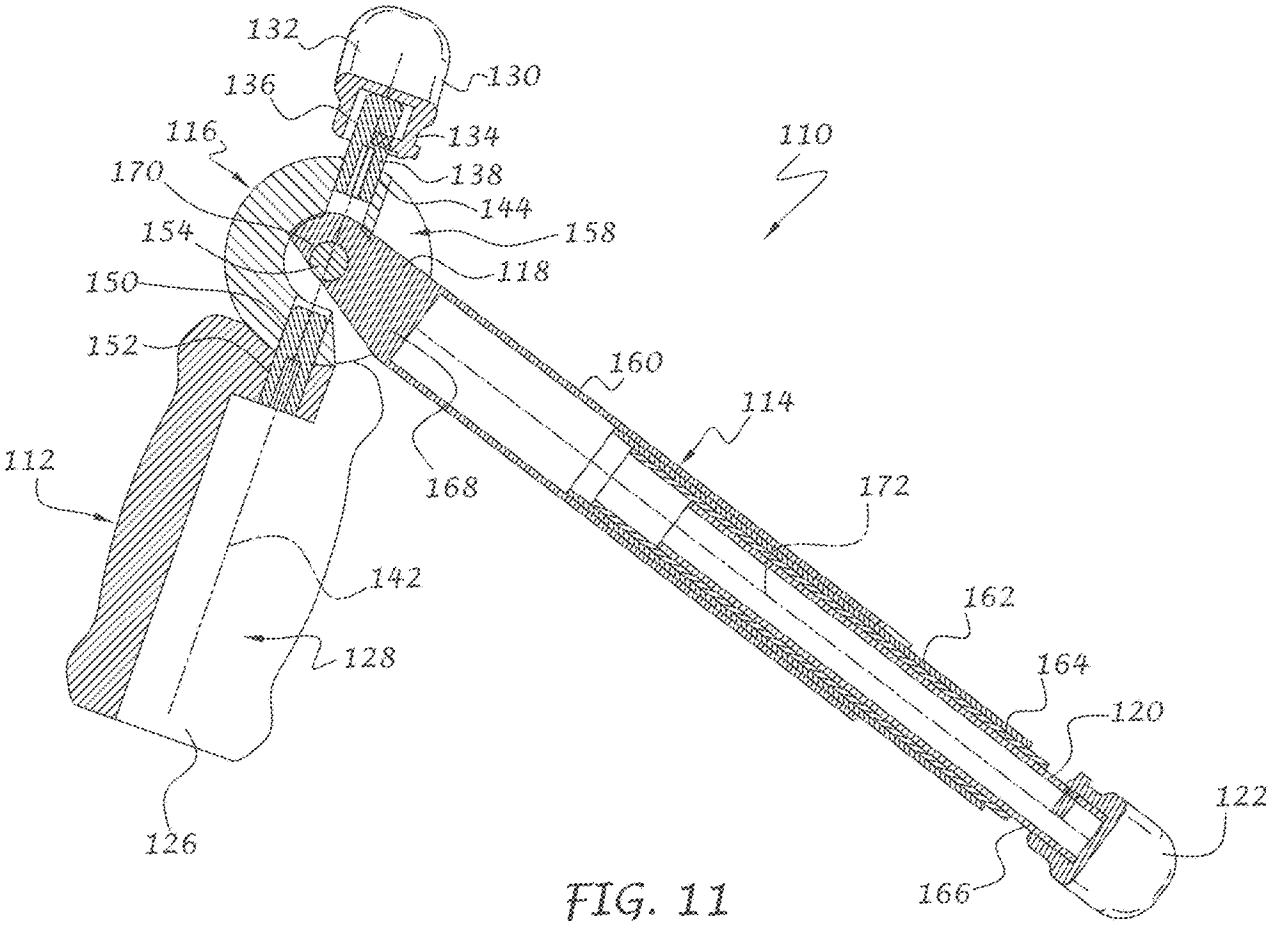
FIG. 11 is a sectional view thereof taken along line 11-11 of FIG. 10 in the retracted position.
Figure 12:
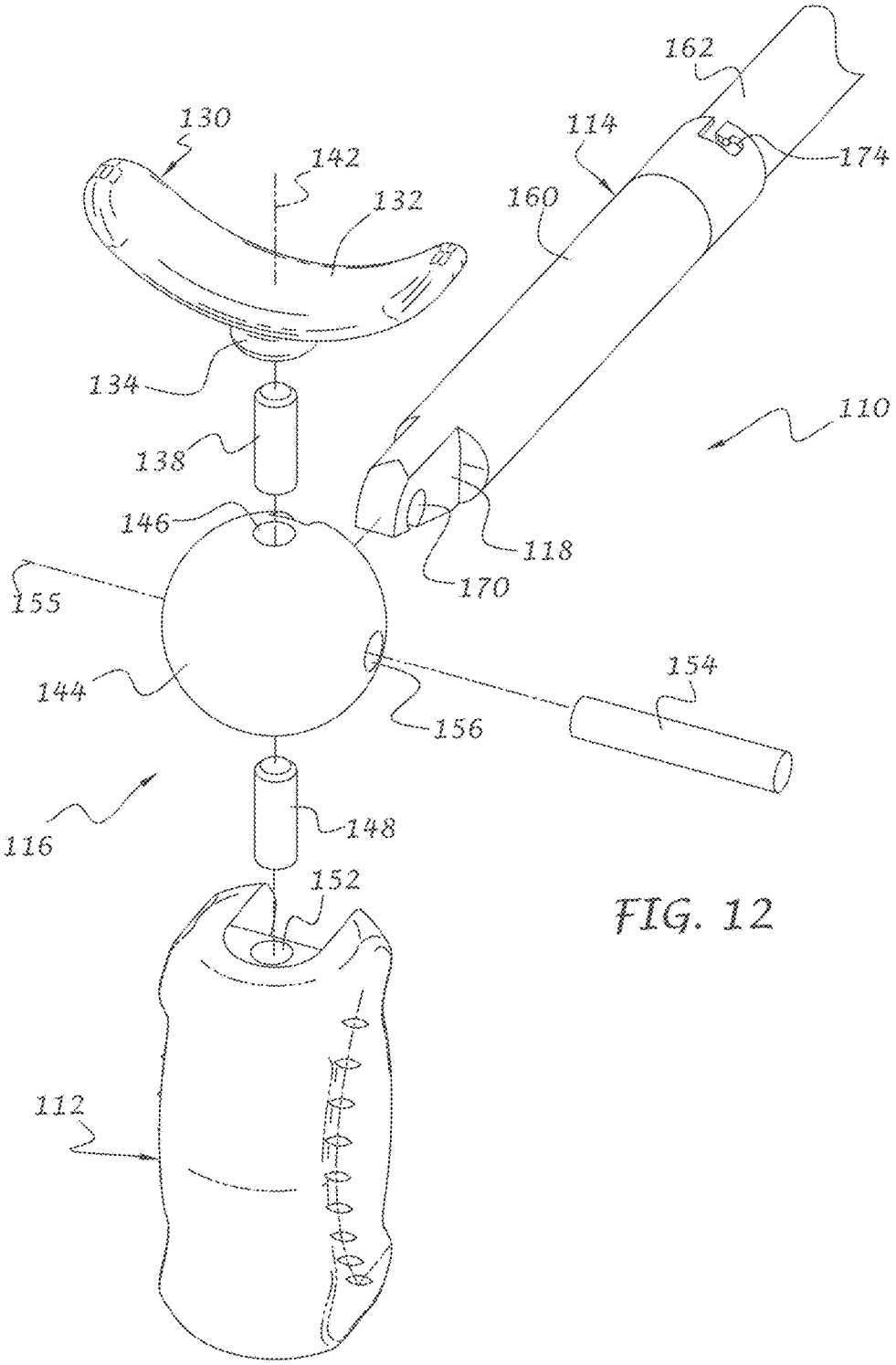
FIG. 12 is an isometric exploded view of the articulated support stick of FIG. 10 with a particular emphasis on the pivot joint construction thereof.

As best shown in FIGS. 10 and 11, the leg assembly 114 includes telescoping tubes 160, 162, 164, and 166 for adjusting the overall length of the support stick 110. This is useful to account for variations in user sizes and preferences, or using the support stick while sitting or standing where the length of the support stick needs to be adjusted. With additional reference to FIG. 12, the first end 118 of the leg assembly 114 extends from the tube 162 and includes a solid plate portion 168 with an aperture 170 that is partially open for receiving the third pivot pin 154 in a snap-fit engagement. In this manner, the leg assembly 114 can rotate about the second pivot axis 155 to allow up and down pivoting movement of the saddle 130 and thus the crossbow or other device. The tube 160 is also capable of rotation about a third pivot axis 172, which also serves as a longitudinal central axis of the telescoping tubes 60, 162, 164, and 166. In this manner, the cant angle of the crossbow or other device can also be adjusted. In this manner, the handle assembly 112, and thus the crossbow or other device, can be pivotally adjusted about three mutually perpendicular axes, thereby providing the user complete control over moving the crossbow between left and right, up and down, and tilting or canting side to side positions so that the user can track an animal based on its position in the hunting field with minimal effort due to the reduction in weight of the crossbow or other device as it is transferred through the leg assembly 114 and to the anchor point or position of the user.

It will be understood that the tube 160 can be secured against movement so that only the first and second axes 142 and 155, respectively, are available for adjusting the position of the crossbow. The tube 160 also includes a locking slot 174 for receiving a pin 176 that projects outwardly from the tube 166 for locking the tubes or the tubes 60, 162, 164, and 166 together in the collapsed position The pin 176 may alternatively be associated with the foot 122 or other structure of the articulated support stick 110 for accomplishing the same purpose. As in the previous embodiment, the tubes may be connected together via friction joints (not shown) or other well-known telescopic connection means.

Although the articulated support sticks 10 and 110 are similar to a certain extent, in that each assembly includes a cradle, an articulated joint, and a leg or leg assembly for transferring the weight of the weapon or other device to an anchor point on the person, thereby facilitating holding and aiming the device during use, there are some noted differences. In the first embodiment, the handle of the articulated support stick 10 is located between the articulated joint assembly and the cradle. In the second embodiment, the articulated joint assembly of the articulated support stick 110 is located between the cradle and the handle. Accordingly, the combination of the cradle, articulated joint, and leg (or leg assembly)

Referring now to FIGS. 13-17, an articulated support stick 180 in accordance with a further embodiment of the invention is illustrated. The articulated support stick 180 preferably includes a handle assembly 182 for grasping and manipulation by a user, a leg assembly 184 for transferring the weight of the crossbow or other device from the user's hand and arm to the user's anchor point 7 (FIG. 1), and an articulated joint assembly 186 for pivotally connecting the handle assembly 182 to the leg assembly 184. As in the previous embodiments, the leg assembly 184 can be telescopic in construction so that the articulated support stick 180 can be collapsed to a compact state for transportation and storage. However, it will be understood that the leg assembly 184 need not be telescopic but may be formed of one or more support tubes that can be removably connected together end-to-end and/or connected to the articulated joint assembly 186. The leg assembly 184 has a first connection end 188 operably associated that forms part of the articulated joint assembly 186, and a second or lower end (not shown) connected to a foot (not shown) for supporting the leg assembly at an anchor point 7 (FIG. 1) of a user or other support, as in the previous embodiments.

The handle assembly 182 is similar to the handle assembly 112 previously described, and preferably includes an ergonomically shaped gripping section 190 formed on a base portion 192. A rear slot 194 is formed in the base portion 192 and is sized to receive a mounting post 196 that extends from the articulated joint assembly 186. As in the previous embodiments, the base portion 192 can be constructed of a durable polymer material, and the gripping section 190 can be constructed of an elastomeric material and bonded to the base section through an overmolding process during manufacture. However, it will be understood that other materials and manufacturing processes and/or means for connecting the gripping section to the base portion can be used. It will be further understood that the base portion 192 can be provided without the gripping section 190 for manipulation by a user without departing from the spirit and scope of the invention.

A saddle 198 includes a curved gripping section 200 for receiving the stock of a crossbow, the barrel of a firearm, and so on, for supporting the weapon or other device when in use. The saddle 198 also includes a circular mounting section 202 that extends downwardly from the gripping section 200. A circular cavity 204 (FIGS. 15 and 17) is formed in the mounting section 202 for receiving an upper or first reduced shaft portion 206 formed on the upper end of the mounting post 196. The reduced shaft portion 206 normally will not be disconnected from the saddle 198 and thus a set screw 208 or the like extends through the wall of the mounting section 202 and engages the shaft portion 206 so that the saddle is fixedly connected to the mounting post 196.

Figure 13:
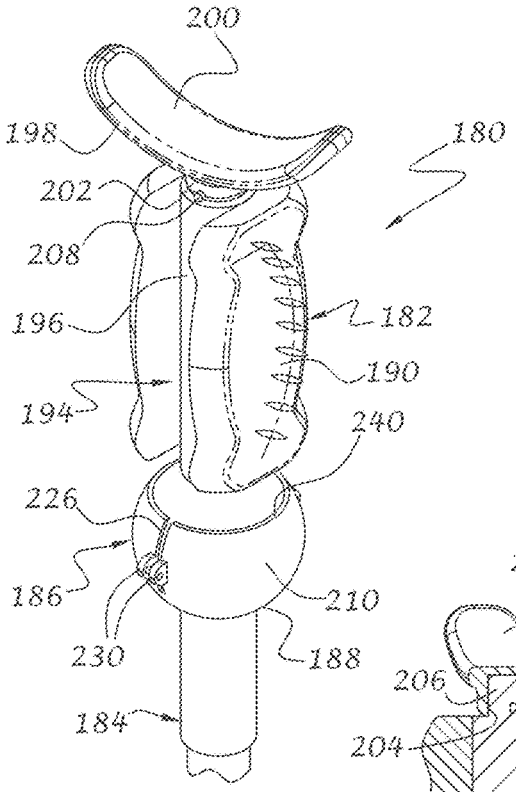
FIG. 13 is an isometric view of an articulated support stick, in accordance with yet another exemplary embodiment of the invention with the leg assembly removed for emphasizing the construction of the pivot joint.
Figure 14:
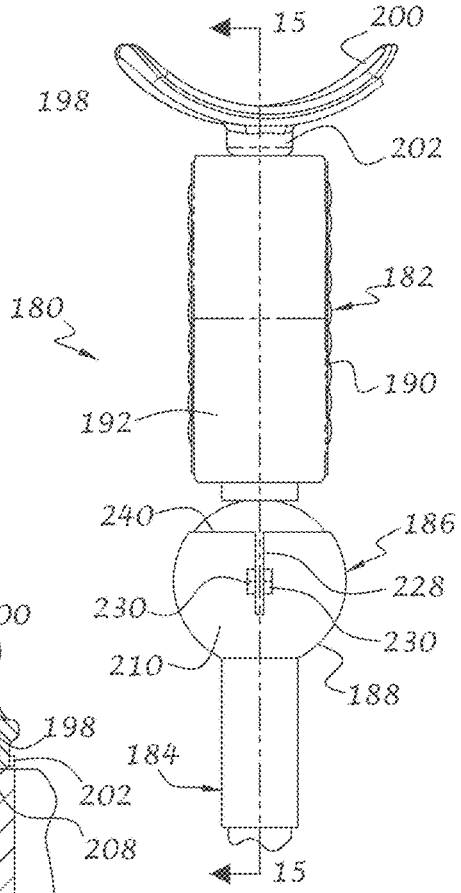
FIG. 14 is a front elevational view thereof.
Figure 15:
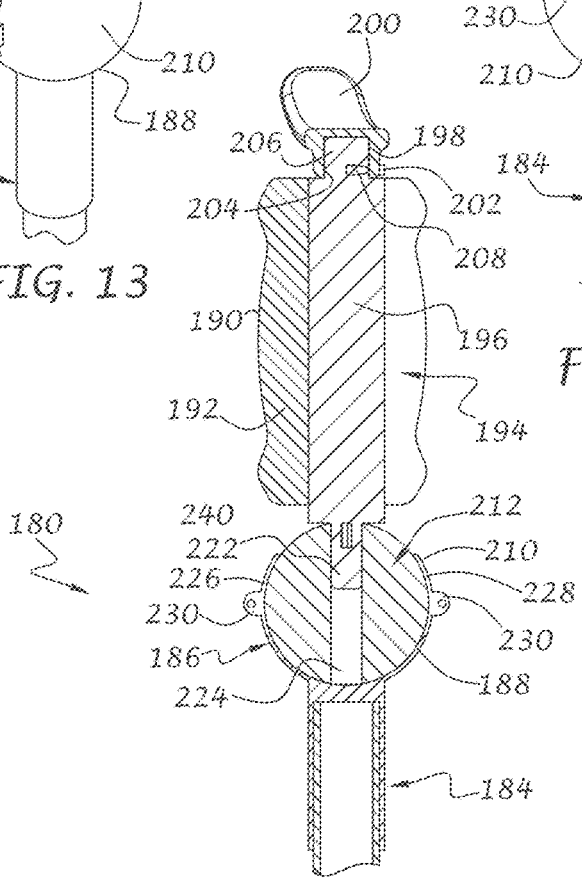
FIG. 15 is a sectional view thereof taken along line 15-15 of FIG. 14.
Figure 16:
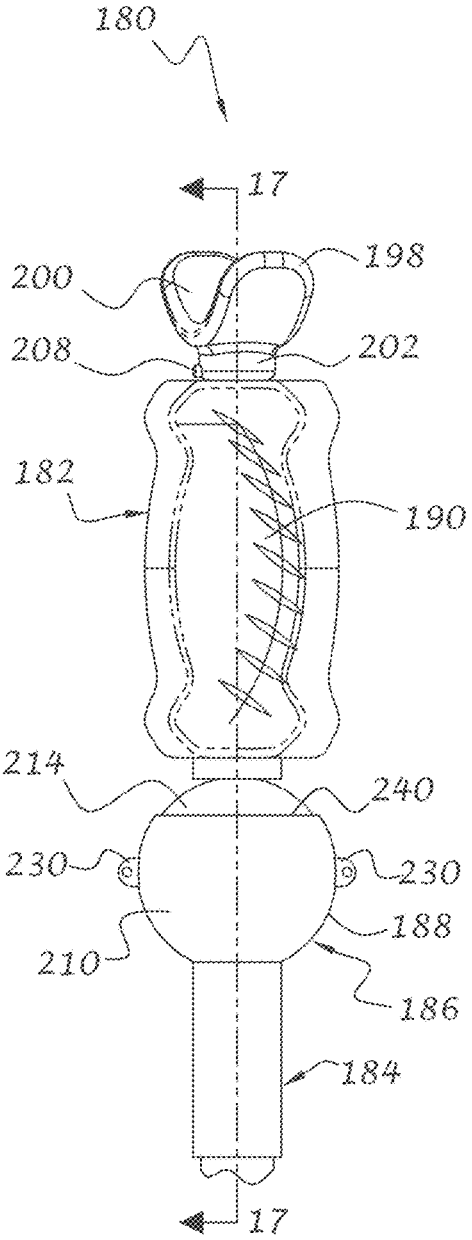
FIG. 16 is a right side elevational view thereof.
Figure 17:
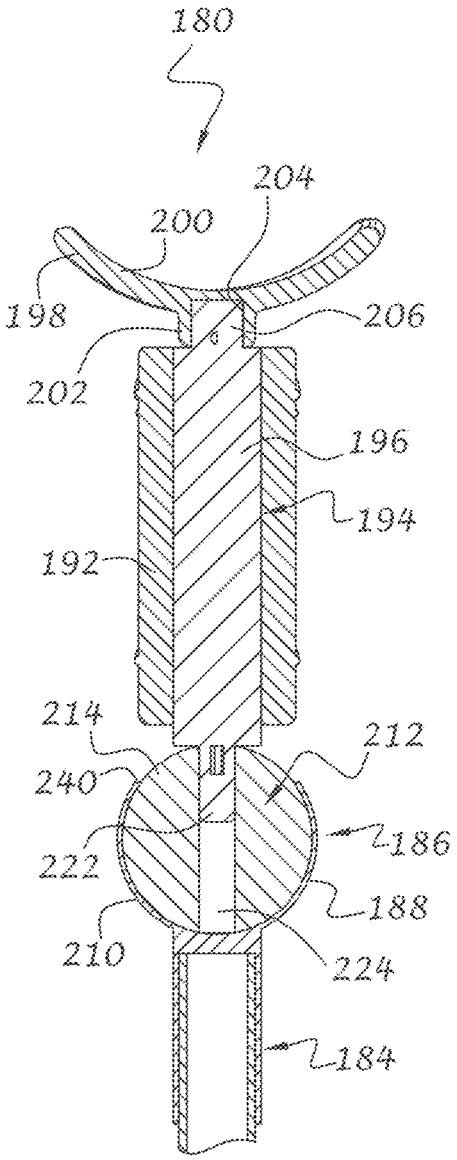
FIG. 17 is a sectional view thereof taken along line 17-17 of FIG. 16.

The articulated joint assembly 186 is preferably in the form of a ball and socket joint and includes a semi-spherical housing 210 with a hollow interior 212 that forms a socket for receiving a ball 214 that is rotatable in the socket about three mutually orthogonal axes 216, 218, and 220 (FIG. 13). The mounting post 196 includes a lower or second reduced shaft portion 222 (FIGS. 15 and 17) that is mounted within a bore 224 of the ball 214 to thereby connect the saddle 198 to the ball and socket joint 186. The housing 210 has a pair of opposing slits 226, 228 to allow expansion of the housing 210 when the ball 214 is inserted in a snap-fit engagement. Tabs 230 are formed on each side of the slits 226, 228 for receiving fasteners (not shown) to adjust the amount of friction between the ball 214 and housing 210 to that the saddle 198 can be adjusted about the three mutually orthogonal axes yet maintain its adjusted position when the weight of a crossbow or other device is incident on the saddle 198. A hollow tube 232 is preferably integrally formed with the housing 210 and forms part of the leg assembly 184 for receiving one or more tubes in a telescoping arrangement, as in the previous embodiments, so that the articulated support stick can be expanded for use and contracted during storage and transportation. Although not shown, a foot or other member can be located at the end of the leg assembly to support the articulated support stick 180 against the user or other object.

As best shown in FIG. 13, the housing 210 is truncated, with an upper edge 240 thereof adapted to abut the handle assembly 182 or portion thereof during movement, and thus limit the amount of pivotal rotation about the three mutually orthogonal axes 216, 218, and 220.

In view of the above exemplary embodiments of the invention, an articulated support stick has been provided that allows a user to hold a weapon in an aiming stance while preserving the user's strength and allowing the user to fine tune a potential shot by manipulating the support stick is a significant advantage over prior art devices. Moreover, due to the orientation of the handle assembly of each embodiment (see FIG. 1 for example), the user's hand is oriented at an approximate 90-degree position from where it would normally be oriented without the articulated support stick, and is spaced away from the stock. Thus, the user's fingers are always clear of the crossbow string during firing, thereby reducing the risk of injury when the present invention is used properly.

It will be understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. It will be understood, therefore, that the present invention is not limited to the particular embodiments disclosed, but also covers modifications within the spirit and scope of the invention as defined by the appended claims.

What is claimed is:

1. An articulated support stick for supporting a weapon or other device, comprising:

a handle having a base portion with a first end section, a second end section, and a gripping section located between the first and second end sections, the gripping section being adapted for grasping by the hand of a user;

a cradle connected to the first end section of the handle for receiving and supporting the weapon or other device;

a leg having a first end portion connected to the second end section of the handle and a second end portion being supportable on a surface for directing at least a portion of the weight of the weapon or other device along the leg and against the surface; and a joint assembly connected between the second end section of the handle and the first end portion of the leg for relative pivoting movement between the handle and leg about a first pivot axis extending in a horizontal direction to thereby allow fine elevational adjustment of the cradle in a vertical direction by the user about the first pivot axis independent of an angular position of the leg and thus allow fine elevational adjustment of the weapon or other device about the first pivot axis, while preserving the user's strength.

2. An articulated support stick of claim 1, wherein the joint assembly comprises a first pivot pin that extends through the second end section of the handle and the first end portion of the leg.

3. An articulated support stick of claim 2, wherein the joint assembly further comprises a second pivot pin extending into the second end section of the handle from the first end portion of the leg to define a second pivot axis perpendicular to the first pivot axis for mutual rotation between at least the cradle and the leg about the second pivot axis independent of the first pivot axis.

4. An articulated support stick according to claim 3, wherein the joint assembly further comprises a third leg pivotally connected to the handle for mutual rotation between the leg and the handle about a third pivot axis perpendicular to the first and second pivot axes.

5. An articulated support stick according to claim 3, wherein the handle and cradle are integrally formed as a single unit such that the handle and cradle pivot together about the second pivot axis.

6. An articulated support stick according to claim 1, wherein the handle and cradle are integrally formed as a single unit such that the handle and cradle pivot together about the first pivot axis.

7. An articulated support stick for supporting a weapon or other device, comprising:

a handle for grasping by a user;

a cradle connected to the handle for receiving and supporting the weapon or other device;

a leg for supporting the handle while directing a portion of the weight of the weapon or other device along the leg; and an articulated joint connected between the handle and the leg so that the handle can be manipulated by the user about a first axis for adjusting elevation of the cradle and a second axis perpendicular to the first axis for adjusting lateral movement of the cradle with respect to the leg to thereby adjust the elevation and lateral movement of the weapon or other device resting on the cradle;

wherein the cradle is connected to the handle on one side thereof and the articulated joint is located between the handle and the leg so that a user's hand is above the articulated joint during use.

8. An articulated support stick according to claim 7, wherein the articulated joint comprises a ball and socket joint.

9. An articulated support stick according to claim 8, wherein the ball and socket joint comprises a semispherical socket and a ball that is received in the socket for mutual rotation about three mutually perpendicular axes.

10. An articulated support stick according to claim 9, wherein the socket comprises a housing with an extension for receiving the leg and the ball comprises a pin for connecting with the cradle.

11. An articulated support stick according to claim 10, wherein the handle is connected to the pin between the cradle and the articulated joint.

12. An articulated support stick according to claim 11, and further comprising at least one slit in the housing for adjusting a frictional force between the ball and socket to thereby allow a user to adjust and hold a position of the cradle.

13. An articulated support stick according to claim 12, wherein the housing is truncated, with an upper edge thereof adapted to abut the handle during movement and thus limit the amount of pivotal rotation about the three mutually orthogonal axes.

14. An articulated support stick according to claim 1, wherein the leg comprises a telescopic leg assembly that can be extended for use and collapsed for storage.

15. An articulated support stick according to claim 14, wherein the telescopic leg assembly comprises a plurality of telescopic tubes extending between the articulated joint and a foot for resting the leg assembly against the user or other object to thereby transfer at least some of the weight of the weapon or other device to a support area of the user or other object.

16. An articulated support stick according to claim 15, and further comprising a compliant assembly connected to the leg for permitting dynamic changes in a length of the articulated support stick during use.

17. An articulated support stick according to claim 1, wherein the handle comprises a handle gripping section constructed of elastomeric material and formed on the base portion of the handle for frictional gripping by the hand of a user.

18. An articulated support stick according to claim 17, wherein the cradle comprises a second gripping section constructed of elastomeric material for frictionally engaging the weapon or other device.

19. An articulated support stick according to claim 1, wherein the cradle comprises a gripping section constructed of elastomeric material for frictionally engaging the weapon or other device.

20. An articulated support stick according to claim 1, and further comprising a laterally extending wing connected to the second end section of the handle for resting against a support surface to thereby provide further stability of the articulated support stick.

* * * * *